US005365962A

United States Patent [19]

Taylor

[11] Patent Number: 5,365,962

[45] Date of Patent: Nov. 22, 1994

[54] FLOW CONTROL SYSTEM AND METHOD OF OPERATING A FLOW CONTROL SYSTEM

[75] Inventor: Stephen A. Taylor, Preston, United Kingdom

[73] Assignee: United Kingdom Atomic Energy Authority, Didcot, United Kingdom

[21] Appl. No.: 920,640

[22] Filed: Jul. 28, 1992

[30] Foreign Application Priority Data

Sep. 3, 1991 [GB] United Kingdom ..... 9119196.5

[51] Int. Cl.[5] ..... F15C 1/16

[52] U.S. Cl. ..... 137/14; 137/810

[58] Field of Search ..... 137/810, 14, 812

[56] References Cited

U.S. PATENT DOCUMENTS 4,887,628 12/1989 Bowe et al. ..... 137/810
4,917,151 4/1990 Blanchard et al. ..... 137/810
5,074,519 12/1991 Davies ..... 137/810

*Primary Examiner*—A. Michael Chambers
*Attorney, Agent, or Firm*—William R. Hinds

[57] ABSTRACT

A fluid flow control system in which a vortex valve is combined in series with a non-fluidic control valve. The non-fluidic control valve is upstream of the vortex valve and is so arranged that small changes in its state control the operation of the vortex valve, which provides the major control over the flow of the fluid. Erosion in the non-fluidic valve due to abrasion or cavitation in the non-fluidic valve is thereby reduced.

7 Claims, 1 Drawing Sheet

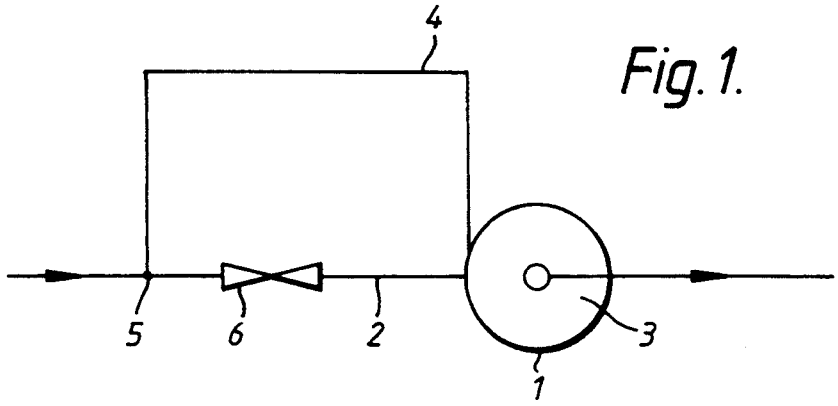
Fig. 1.
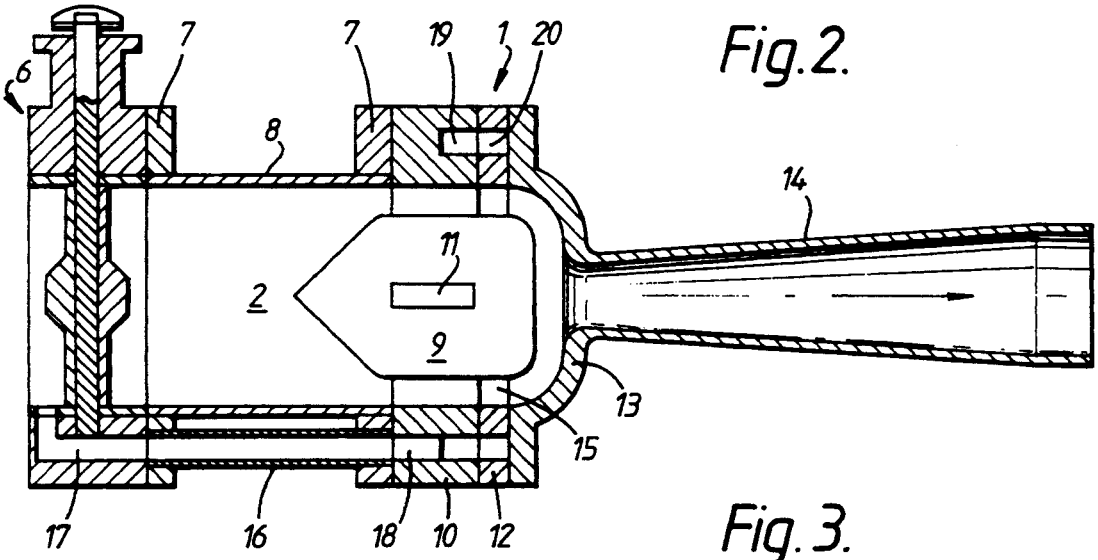
Fig. 2.
Fig. 3.
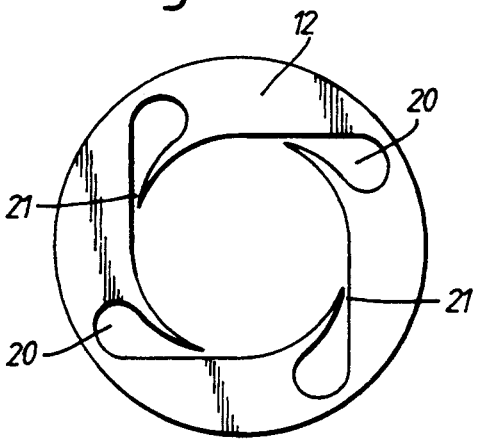

FLOW CONTROL SYSTEM AND METHOD OF OPERATING A FLOW CONTROL SYSTEM

AN IMPROVED FLOW CONTROL SYSTEM

The present invention concerns fluid flow control systems.

A major problem with industrial fluid flow systems, particularly when a fluid is abrasive, such as a slurry or aerosol, or contains dissolved gases, is erosion of control valves included in the fluid flow systems, due either to the abrasive nature of the fluid itself, or to cavitation when the valves are operating in a state in which they present considerable resistance to the flow of the fluid.

It is an object of the present invention to provide a fluid flow control system and method of operating a fluid flow control system in which the erosion of control valves is reduced.

Generally according to the present invention a fluid flow control system includes a vortex valve comprising a vortex chamber having an inlet for a main fluid flow to be controlled by the vortex valve and an inlet for a control fluid, a non-fluidic control valve in the main fluid flow line upstream of the vortex valve, and means for using differences between the fluid pressures in the main and control fluid flow lines arising from changes in the state of the non-fluidic control valve to control the action of the vortex valve.

Also generally in accordance with the invention, a method of operating a fluid flow control system including a vortex valve comprising a vortex chamber having an inlet for a main fluid flow to be controlled by the vortex valve and an inlet for a control fluid, together with a non-fluidic control valve in the main fluid flow line upstream of the vortex valve, comprises the operation of varying the operating state of the non-fluidic control valve to create a difference between the pressure of fluid flowing in the main fluid flow line and that of a control fluid in the control flow line thereby to effect the operation of the vortex valve to control the flow of fluid in the main fluid flow line.

The non-fluidic valve can be any form of mechanical valve, such as for example a tap, butterfly or diaphragm and can be operated manually or by power means.

The invention will be described further, by way of example, with reference to the accompanying diagrammatic drawings, in which:

FIG. 1 is a diagrammatic sketch of a flow control system;

FIG. 2 is an embodiment of the flow control system; and

FIG. 3 illustrates a component part of a vortex valve.

The drawing shows a vortex valve 1 included in a flow line 2 for a fluid which can be gas or liquid. The vortex valve is a fluidic device having a vortex chamber 3 with inlet, outlet and control ports. In the present arrangement fluid flowing along the flow line 2 in the direction indicated by the arrow enters radially into the vortex chamber 3 at the inlet port and emerges axially from the chamber 3 at the outlet port.

A further flow line 4 is connected to the control port or ports of the vortex valve 1 and extends to a junction 5 in the first flow line 2 upstream of the vortex valve 1. A non-fluidic valve 6 is included in the flow line 2 at a position between the junction 5 and the vortex valve 1. The valve 6 can be any suitable type of mechanical valve and as example only mention can be made of butterfly and diaphragm valves. In addition the valve 6 can be operated by hand or by power means. The further flow line 4 can itself form or can include a flow restrictor to provide required divisions of flow between the lines 2 and 4.

In use and with the valve 6 fully open fluid in the line 2 can flow unhindered through both the valve 6 and the vortex valve 1. In the absence of control flow the vortex valve is in its low resistance mode.

Upon closing the valve 6, a pressure difference is created across the valve 6 with the result that the pressure at the inlet to the vortex valve 1 is less than the pressure at the upstream side of the valve 6 and hence is less than the pressure in the further flow line 4 to the control port. Thus, closing the valve 6 causes an increase in the pressure difference between the control and inlet ports. The control flow along the further flow line 4 acts on the flow along the line 2 to create a vortex in the vortex chamber 3 to thereby increase the flow resistance of the vortex valve 1. The resistance of the vortex valve 1 increases progressively with the closing of the valve 6.

The combination of the valve 6 and the vortex valve 1 functions as a control in the flow line 2. A small pressure drop across the valve 6 resulting in a small control flow can cause a significant increase in the resistance of the vortex valve 1 to flow along the line 2. The advantage from this arrangement compared to a non-fluidic valve alone in the flow line 2 is that the main resistance to flow occurs in the vortex valve 1 and does not take place at the valve 6. As mentioned a slight closing of the valve 6 can effect a considerable increase in the flow resistance of the vortex valve 1. Upon closing the valve 6 the flow velocity therethrough increases with consequent problems of erosion and cavitation effects on the valve 6. In combination with the vortex valve it is not necessary to close the valve 6 to the same extent as when using the valve 6 alone to obtain the same control in the flow. As a result the problems of erosion and cavitation are reduced with improved life for the valve 6.

FIGS. 2 and 3 show one embodiment of the system and where applicable the same reference numerals are used in FIG. 2 to denote the corresponding components in FIG. 1.

In FIG. 2, the vortex valve 1 and the non-fluidic valve 6 are mounted or secured to flanges 7 at the ends of a short length of pipe 8, the pipe being a part of the flow line 2. In this embodiment the valve 6 is a butterfly valve.

The vortex valve 1 comprises a body 9 centrally supported within an annular body 10 by a spider 11. The body 10 is secured to the flange 7 at the end of the pipe 8. An annular plate 12 is mounted on the body 10 and the valve 1 is completed by a cover housing 13 secured to the plate 12. An outlet diffuser 14, being a part of the flow line 2, extends axially from the cover housing 13.

A vortex chamber 15 is formed between the body 9 and the annular body 10 and the plate 12. The body 9 comprises a cylindrical portion with a conical portion directed towards the valve 6.

A conduit 16 provides communication between apertures in the flanges 7. A passage 17 in the housing of the valve 6 extends from the conduit 16 to open into the flow line 2 immediately upstream of the butterfly valve 6, the flow direction being shown by the arrow in FIG. 2. A similar passage 18 in the annular body 10 provides communication between the conduit 16 and a continuous circular groove 19 formed in the face of the annular body 10 abutting against the annular plate 12.

As shown in FIG. 3, the annular plate 12 is formed with four equiangularly spaced apart channels or slots 20, each slot 20 having a nozzle 21 communicating substantially tangentially with the bore of plate 12.

The path formed by the passage 17, the conduit 16, passage 18, groove 19, slots 20 and nozzles 21 corresponds to the flow line 4 in FIG. 1.

We claim:

1. A method of operating a fluid flow control system including a vortex valve comprising a vortex chamber having an inlet for a main fluid flow to be controlled by the vortex valve and an inlet for a control fluid, together with a non-fluidic control valve in the main fluid flow line upstream of the vortex valve, comprising the operation of varying the operating state of the non-fluidic control valve to create a difference between the pressure of fluid flowing in the main fluid flow line and that of a control fluid in the control flow line thereby to effect the operation of the vortex valve to control the flow of fluid in the main fluid flow line.

2. A method as claimed in claim 1 wherein the control fluid is taken from said main fluid flow line upstream of said non-fluidic valve and is not separately pumped or pressurized relative to the main fluid flow line, such that said pressure difference is automatically effected in dependence on the state of said non-fluidic valve.

3. A fluid flow control system including a vortex valve comprising a vortex chamber having an inlet for a main fluid flow to be controlled by the vortex valve and an inlet for a control fluid, wherein there is included a non-fluidic control valve in the main fluid flow line upstream of the vortex valve, and including means for using differences between the fluid pressures in the main and control fluid flow lines arising from changes in the state of the non-fluidic control valve to control the action of the vortex valve.

4. A fluid flow control system according to claim 3 wherein the control fluid is derived directly from the main fluid flow line upstream of the non-fluidic control valve so that initially the main and control fluids are at substantially the same pressure.

5. A fluid flow control system as claimed in claim 4 wherein the control fluid flow line is devoid of separate pumping or pressurizing means relative to the main fluid flow line.

6. A fluid flow control system comprising a cylindrical vortex chamber adapted to form part of a main fluid flow line and having an inlet and an axial outlet, a plurality of tangential inlet ports situated at the downstream end of the cylindrical chamber for a control fluid, a non-fluidic control valve situated in the main fluid flow line upstream of the inlet to the cylindrical vortex chamber, a control fluid flow line connecting the main fluid flow line upstream of the non-fluidic control valve to the control ports, and means for varying the state of the non-fluidic control valve thereby to create a difference between the fluid pressure in the main fluid flow line at the inlet to the vortex chamber and that in the control fluid flow line thereby to effect the operation of the vortex valve.

7. A fluid flow control system as claimed in claim 6 wherein the control fluid flow line is devoid of separate pumping or pressurizing means relative to the main fluid flow line.

* * * * *